US007059361B1

(12) United States Patent
Hansson

(10) Patent No.: US 7,059,361 B1
(45) Date of Patent: Jun. 13, 2006

(54) STABLE FORMING FABRIC WITH HIGH FIBER SUPPORT

(75) Inventor: Rita Hansson, Halmstad (SE)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 11/117,215

(22) Filed: Apr. 28, 2005

(51) Int. Cl.
*D21F 3/00* (2006.01)

(52) U.S. Cl. ..... 139/383 A; 162/358.2; 162/900; 162/902; 162/903

(58) Field of Classification Search ..... 139/383 A, 139/383 R; 442/203, 205; 162/358.2, 900, 162/902, 903
See application file for complete search history.

(56) References Cited

U.S. PATENT DOCUMENTS

| | | | | | |
|---|---|---|---|---|---|
| 4,379,735 | A | | 4/1983 | MacBean | |
| 4,564,051 | A | | 1/1986 | Odenthal | |
| 4,909,284 | A | * | 3/1990 | Kositzke | 139/383 A |
| 4,941,514 | A | | 7/1990 | Taipale | |
| 5,025,839 | A | | 6/1991 | Wright | |
| 5,164,249 | A | | 11/1992 | Tyler et al. | |
| 5,169,709 | A | | 12/1992 | Fleischer | |
| 5,343,896 | A | * | 9/1994 | Schroder et al. | 139/383 A |
| 5,366,798 | A | | 11/1994 | Ostermayer | |
| 5,454,405 | A | * | 10/1995 | Hawes | 139/383 A |
| 5,482,567 | A | * | 1/1996 | Barreto | 139/383 A |
| 5,840,378 | A | | 11/1998 | Nagura et al. | |
| 5,857,498 | A | | 1/1999 | Barreto et al. | |
| 5,881,764 | A | | 3/1999 | Ward | |
| 5,887,630 | A | * | 3/1999 | Shipley | 139/383 A |
| 5,967,195 | A | | 10/1999 | Ward | |
| 6,179,013 | B1 | | 1/2001 | Gulya | |
| 6,207,598 | B1 | * | 3/2001 | Lee et al. | 442/206 |
| 6,227,256 | B1 | * | 5/2001 | Quigley | 139/383 A |
| 6,834,684 | B1 | * | 12/2004 | Martin et al. | 139/383 A |
| 6,899,143 | B1 | * | 5/2005 | Rougvie et al. | 139/383 A |
| 6,902,652 | B1 | * | 6/2005 | Martin | 162/348 |
| 6,905,574 | B1 | * | 6/2005 | Festor | 162/348 |
| 6,920,902 | B1 | * | 7/2005 | Majaury et al. | 139/383 A |
| 6,953,065 | B1 | * | 10/2005 | Martin et al. | 139/383 A |

FOREIGN PATENT DOCUMENTS

| | | | |
|---|---|---|---|
| EP | 1 195 462 | A | 4/2002 |

* cited by examiner

*Primary Examiner*—John J. Calvert
*Assistant Examiner*—Robert H Muromoto
(74) *Attorney, Agent, or Firm*—Frommer Lawrence & Haug LLP; Ronald R. Santucci

(57) ABSTRACT

A papermaker's fabric having first and second layers of machine direction (MD) yarns interwoven with alternating first and second systems of cross-machine-direction (CD) yarns. The first system is comprised of first and second CD yarns while the second system is comprised of third, fourth, and fifth CD yarns. The first and second CD yarns form a binding pair of yarns which combine to weave each MD yarn in the first layer and cross between the first layer and the second layer. The fourth CD yarn weaves each MD yarn in the first layer. The fifth CD yarn weaves with at least one MD yarn in the second layer. The third CD yarn is positioned between the fourth and fifth CD yarns. The third, fourth, and fifth CD yarns are vertically-stacked.

15 Claims, 5 Drawing Sheets a) CD cross-section picture along binder yarn pair b) CD cross-section picture along TSS structure c) forming surface picture a) CD cross-section picture along binder yarn pair b) CD cross-section picture along TSS structure c) forming surface picture

STABLE FORMING FABRIC WITH HIGH FIBER SUPPORT

BACKGROUND OF THE INVENTION

1. Field of the Invention

The present invention relates to the papermaking arts. More specifically, the present invention relates to forming fabrics for the forming section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Woven fabrics take many different forms. For example, they may be woven endless, or flat woven and subsequently rendered into endless form with a seam.

The present invention relates specifically to the forming fabrics used in the forming section. Forming fabrics play a critical role during the paper manufacturing process. One of its functions, as implied above, is to form and convey the paper product being manufactured to the press section.

However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric woven from monofilament, plied monofilament, multifilament or plied multifilament yarns, and may be single-layered or multi-layered. The yarns are typically extruded from any one of several synthetic polymeric resins, such as polyamide and polyester resins, used for this purpose by those of ordinary skill in the paper machine clothing arts.

Those skilled in the art will appreciate that fabrics are created by weaving, and having a weave pattern which repeats in both the warp or machine direction (MD) and the weft or cross-machine direction (CD). It will also be appreciated that the resulting fabric must be uniform in appearance; that is there are no abrupt changes in the weave pattern to result in a mark in the formed paper sheet.

The design of forming fabrics additionally involves a compromise between the desired fiber support and fabric stability. A fine mesh fabric may provide the desired paper surface and fiber support properties, but such design may lack the desired stability resulting in a short fabric life. By contrast, coarse mesh fabrics provide stability and long life at the expense of fiber support and the potential for marking. To minimize the design tradeoff and optimize both support and stability, multi-layer fabrics were developed. For example, in double and triple layer fabrics, the forming side is designed for support while the wear side is designed for stability.

In addition, triple layer designs allow the forming surface of the fabric to be woven independently of the wear surface. Because of this independence, triple layer designs can provide a high level of fiber support and an optimum internal void volume. Thus, triple layers may provide significant improvement in drainage over single and double layer designs.

Essentially, triple layer fabrics consist of two fabrics, the forming layer and the wear layer, held together by binding yarns. The binding is extremely important to the overall integrity of the fabric. One problem with triple layer fabrics has been relative slippage between the two layers which breaks down the fabric over time. In addition, the binding yarns can disrupt the structure of the forming layer resulting in marking of the paper.

Furthermore, it is desired that multi-layer fabrics have more cross-directional stability and stiffness to prevent cross directional shrinkage, improve sheet formation and appearance, and potentially increase life.

The present invention is a triple-layer fabric which provides a solution to the problems of surface uniformity, sheet fiber support, and fabric stability.

SUMMARY OF THE INVENTION

Accordingly, the present invention is directed to a triple-layer forming fabric, although it may find application in the forming, pressing and drying sections of a paper machine.

A preferred embodiment according to the present invention is a papermaker's fabric having first and second layers of machine direction (MD) yarns interwoven with alternating first and second systems of cross-machine-direction (CD) yarns. The first system is comprised of first and second CD yarns while the second system is comprised of third, fourth, and fifth CD yarns. The first and second CD yarns form a binding pair of yarns which combine to weave each MD yarn in the first layer and cross between the first layer and the second layer. The fourth CD yarn weaves each MD yarn in the first layer. The fifth CD yarn weaves with at least one MD yarn in the second layer. The third CD yarn is positioned between the fourth and fifth CD yarns. The third, fourth, and fifth CD yarns are vertically-stacked.

Other aspects of the invention include that the fabric may be a triple layer forming fabric; in which case the first layer is a forming layer and the second layer is a wear side layer. The fabric may have a 2:1 shute ratio; or any other shute ratio known in the art. At least some of the MD yarns and CD yarns may be monofilament yarns. The binding pair may be woven in a reverse pick configuration or a straight pick configuration. The binding pair may also be woven in a sheet support binder (SSB) sequence. The second system of CD yarns may form a triple stacked shute (TSS) structure. Some of the fifth CD yarns may form long floats (i.e. runners) on the outer surface of the second layer. The third CD yarn may be a different material and/or a different diameter than the fourth and fifth CD yarns. The third CD yarn may be positioned between the first and second layers or it may bind with one or more of the MD yarns in the second layer.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

The present invention pertains to a fabric such as a triple layer fabric which may be utilized in a papermaking process. Such triple layer fabrics may include a first (upper) layer and a second (lower) layer in which each of the first and second layers has a system of MD yarns and CD yarns interwoven therewith. The first layer may be a paper side or forming layer upon which the cellulosic paper/fiber slurry is deposited during the papermaking process and the second layer may be a machine side or wear side layer in contact with the papermaking machine. The first and second layers may be held together by use of a number of stitching or binding yarns. Such stitching yarns may be a number of CD and/or MD yarns. For example, a number of pairs of CD yarns may be used wherein the two yarns of each pair are located adjacent to each other and work in parallel. A pair of such CD yarns may be an integral or non-integral part of the weave pattern of either or both of the first and second layers and may also bind the two layers together.

One class of triple-layer fabrics uses a sheet support binder (SSB) system wherein the binder yarns are part of the structure supporting the fabric. Such SSB fabrics often use pairs of binder yarns which are intrinsic to the forming layer. Typically, the binding yarns combine to produce a plain weave pattern on the forming surface of the fabric. SSB fabrics exhibit good surface uniformity characteristics.

Another class of triple-layer fabrics is referred to as triple stacked shute (TSS) fabrics. TSS fabrics incorporate three layers of vertically-stacked CD yarns (i.e. shutes). The triple stacked shutes add to the caliper of the fabric and increase the void volume. Several closely related patents exist covering TSS designs; e.g. U.S. Pat. No. 4,379,735, U.S. Pat. No. 4,941,514, U.S. Pat. No. 5,164,249, U.S. Pat. No. 5,169,709 and U.S. Pat. No. 5,366,798. While all of these patents describe TSS fabrics, none has a surface uniformity deemed to be favorable. The present invention combines favorable characteristics from both the SSB fabrics and the TSS fabrics.

An exemplary fabric according to the present invention is a triple-layer forming fabric comprised of forming and wear-side layers of MD yarns interwoven with two alternating systems of CD (weft) yarns. In the first system, a pair of weft yarns act to bind together the layers of the fabric in an SSB sequence. The wefts in this binding pair also combine to produce a plain weave pattern in the surface of the forming layer. In the second system, three weft yarns are vertically-stacked, perpendicular to the layers to produce a TSS structure. One of the three weft yarns is positioned between the other two weft yarns. In this manner, the present fabric incorporates the characteristics of both SSB and TSS fabrics.

Figure 1A:
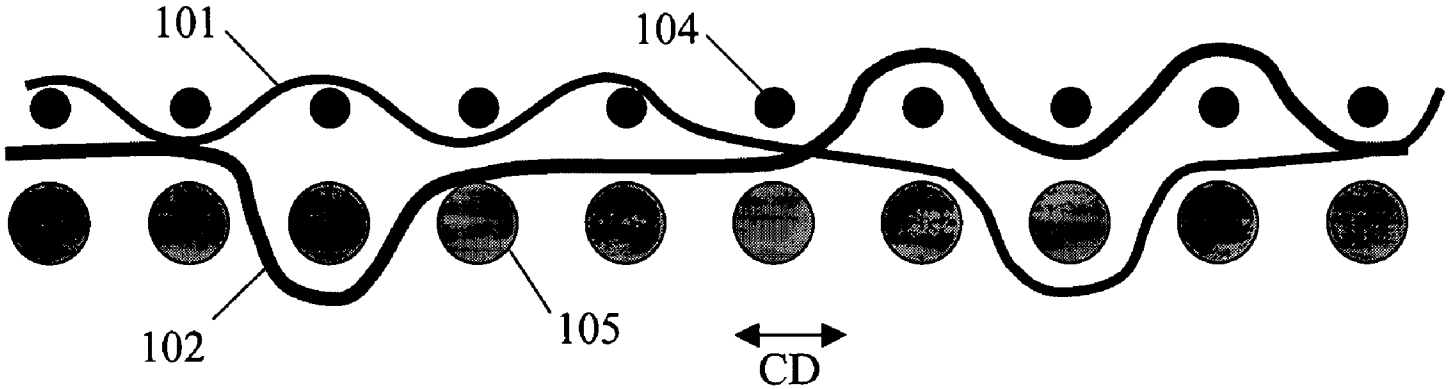
FIG. 1A is a cross-sectional view in the CD showing the binder yarn contours for an exemplary triple-layer fabric in accordance with the teachings of the present invention.

FIG. 1A is a cross-sectional view in the CD showing the binder yarn contours of the first system of CD yarns for the exemplary triple-layer fabric having a forming layer of MD yarns 104 and a wear-side layer of MD yarns 105 in accordance with the teachings of the present invention. The forming layer MD yarns are interwoven in an SSB sequence by a pair of intrinsic CD binder yarns 101, 102 which combine to produce a plain weave pattern. This pattern provides a uniform surface and structural stability for the forming layer. As shown, the binder pair is intrinsic to the forming layer, but simply binds with the wear-side layer.

Figure 1B:
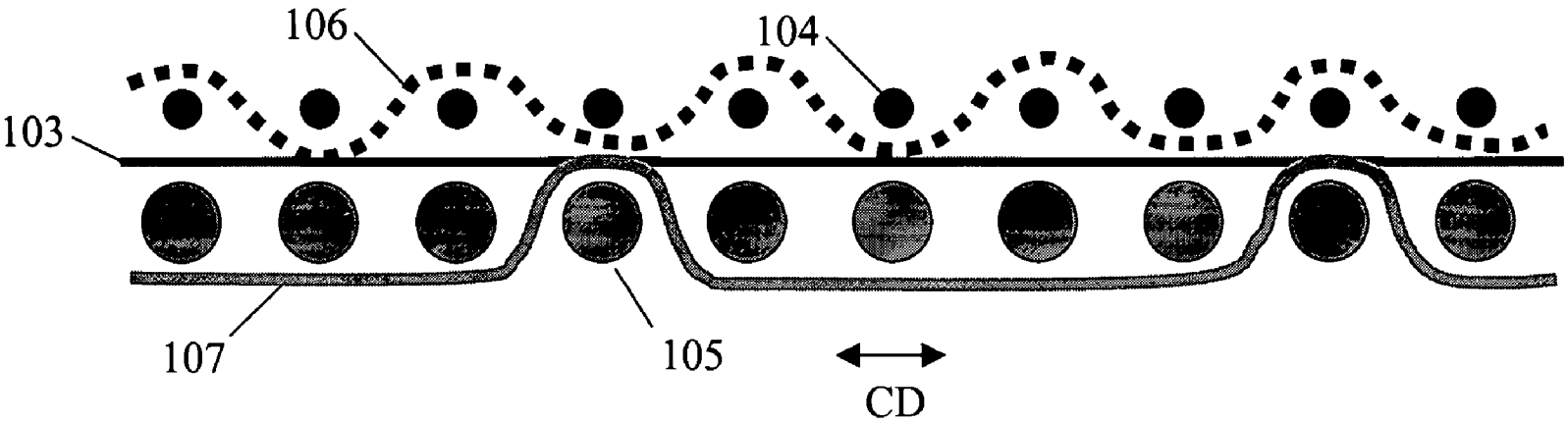
FIG. 1B is a cross-sectional view in the CD showing the TSS (triple stacked shute) structure for the second system of CD yarns which alternates with the binder yarn pairs in the exemplary triple-layer fabric shown in FIG. 1A.

The binder yarn pairs alternate weaving the MD yarns with the second system of CD yarns. FIG. 1B is a cross-sectional view in the CD showing the TSS structure of the second system of CD yarns for the exemplary triple-layer fabric shown in FIG. 1A. This second system is comprised of a third CD yarn 103 positioned between the layers, a fourth CD yarn 106 which weaves a plain weave pattern with the MD yarns 104 in the forming layer, and a fifth CD yarn 107 which weaves with the MD yarns 05 in the wear-side layer. In this example, the third CD yarn 103 is not interwoven with the MD yarns of either layer, but as discussed below the invention is not limited as such. The fifth CD yarn 107 may form long floats (i.e. runners) on the outer surface of the fabric. Although not visible from this view, these three CD yarns 101, 106, and 1.07 are vertically-stacked (perpendicular to the horizontally shown layers) to produce a TSS configuration.

Figure 2:
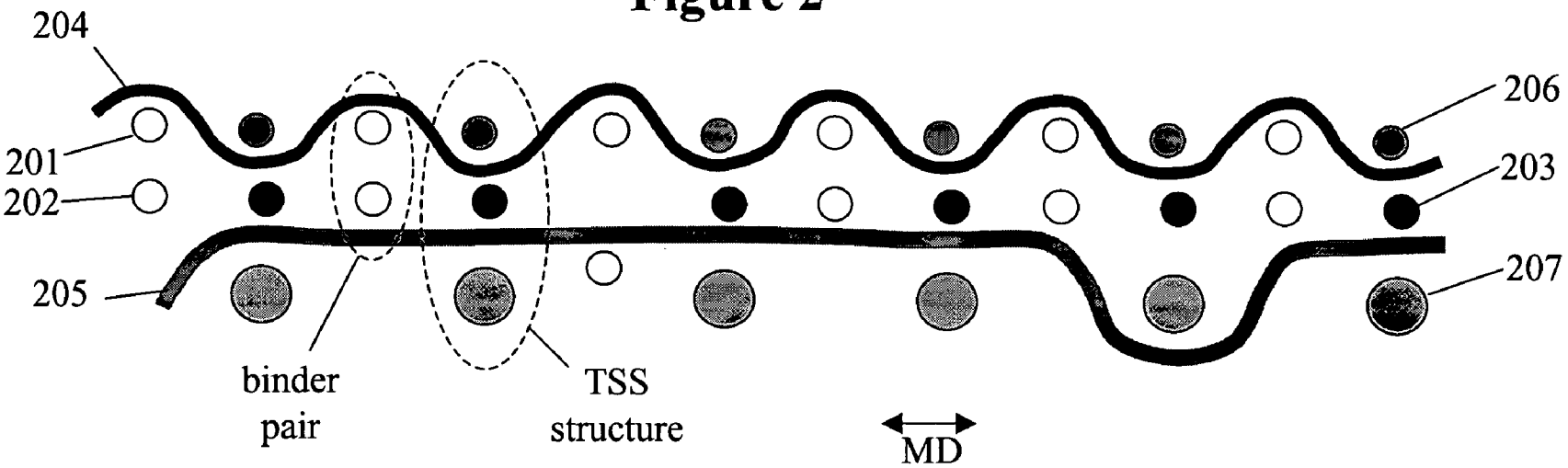
FIG. 2 is a cross-sectional view in the MD of the exemplary triple-layer fabric shown in FIGS. 1A and 1B.

FIG. 2 is a cross-sectional view in the MD of the exemplary triple-layer fabric shown in FIGS. 1A and 1B. MD yarn 204 weaves only in the forming layer and provides a plain weave pattern. Likewise, MD yarn 205 weaves only in the wear-side layer. As shown in FIG. 2, the first system CD yarns 201 and 202 which form the binder yarn pairs alternate with the vertically stacked second system CD yarns 203, 206, and 207 which provide the TSS structure to provide a 2:1 shute ratio. Herein the shute ratio is defined as the total number of CD yarns in the forming layer to the number of binding pairs in the forming layer. Importantly, this embodiment is only one exemplary fabric and the present invention should not be limited as such.

Figure 3:
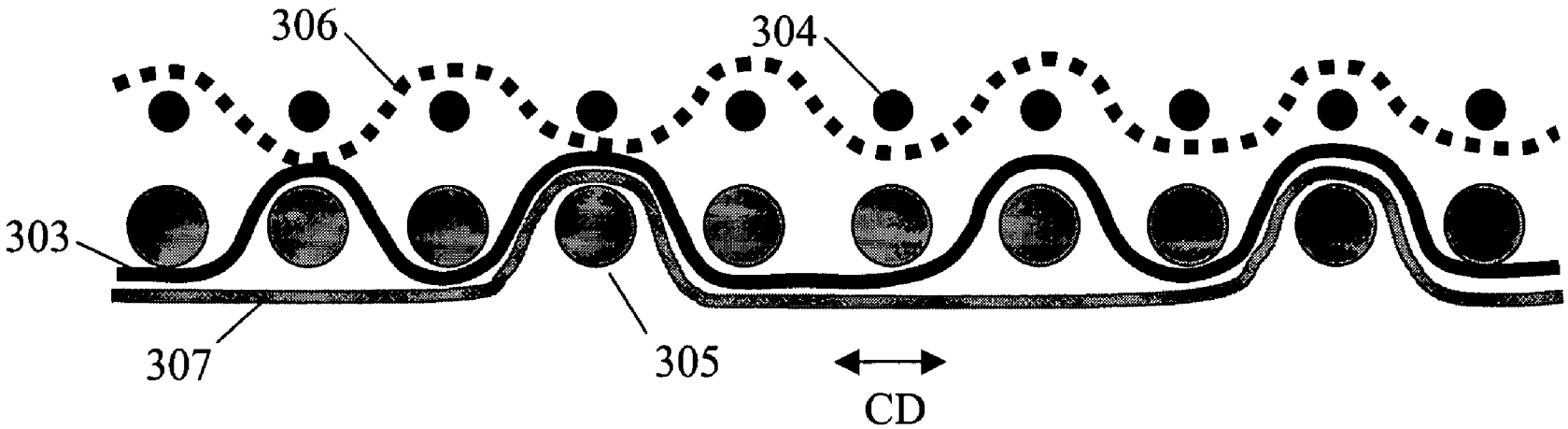
FIG. 3 is a cross-sectional view in the CD showing an alternate configuration for the second system of CD yarns of another exemplary triple-layer fabric in accordance with the teachings of the present invention.

FIG. 3 is a cross-sectional view in the CD showing an alternate configuration for the second system of CD yarns for another exemplary triple-layer fabric in accordance with the teachings of the present invention. For this fabric, the second system comprises a third CD yarn 303 which binds with (but is not integral to) the wear-side layer, a fourth CD yarn 306 weaves a plain weave pattern with the MD yarns 304 in the forming layer, and a fifth CD yarn 307 which weaves with the MD yarns 305 in the wear-side layer. Stitching the third CD yarn 303 to the bottom layer in this manner assists in preventing slippage from its position in the TSS structure of the fabric pattern. Note, the third CD yarn 303 always remains positioned between the fourth and fifth CD yarns to maintain the TSS structure.

Other aspects of the invention include that the fabric may be a triple layer forming fabric; in which case the first layer is a forming layer of the fabric and the second layer is a wear side layer of the fabric. The fabric may have a 2:1 shute ratio, or any other shute ratio known in the art by the addition of more first or second system CD yarns, or independent CD yarns. The binding pair may be woven in a reverse pick configuration or a straight pick configuration. The binding pair may also be woven in a sheet support binder (SSB) sequence. The second system of CD yarns may form a triple stacked shute (TSS) structure. Some of the fifth CD yarns may form long floats on the outer surface of the second layer. The third CD yarn may be a different material and/or a different diameter than the fourth and fifth CD yarns. The third CD yarn may be positioned between the first and second layers or it may bind with one or more of the MD yarns in the second layer. Note, these examples are simply representative examples of the invention and are not meant to limit the invention.

Figure 4:
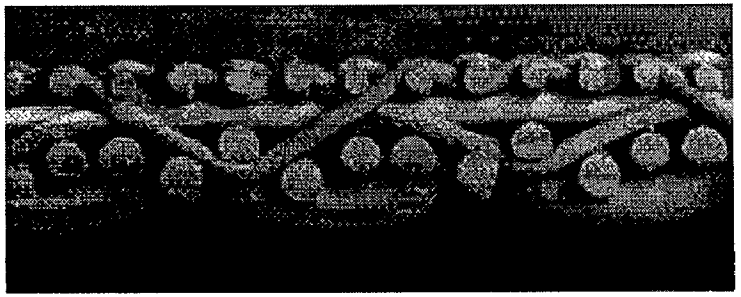
FIG. 4 shows: a) a CD cross-section picture along a binder yarn pair, b) a CD cross-section picture along the TSS structure, and c) a forming surface picture for the exemplary fabric shown in FIGS. 1A, 1B, and 2.
Figure 4:
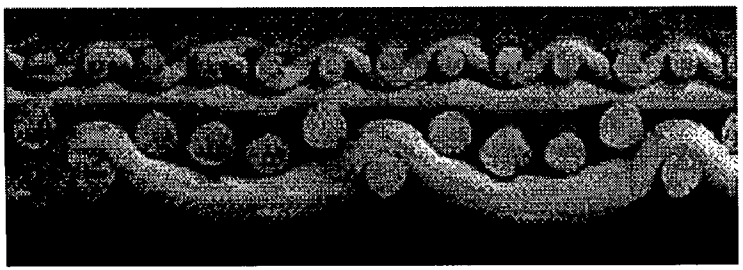
Figure 4:
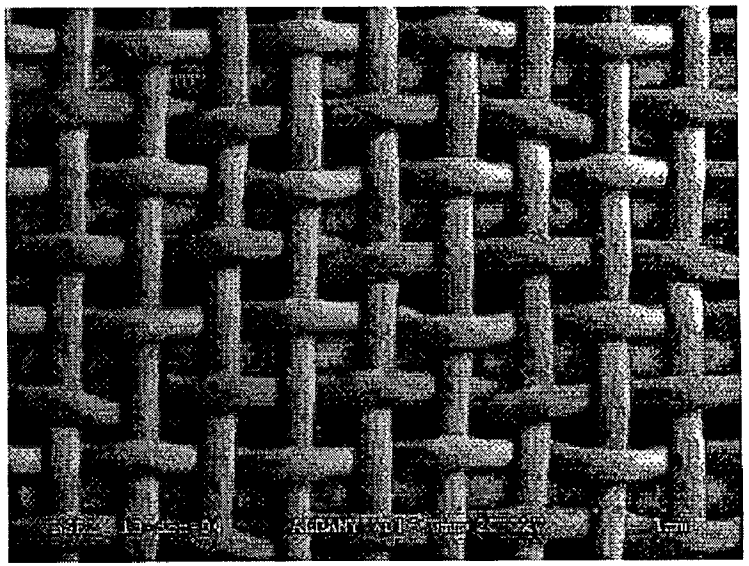
Figure 5:
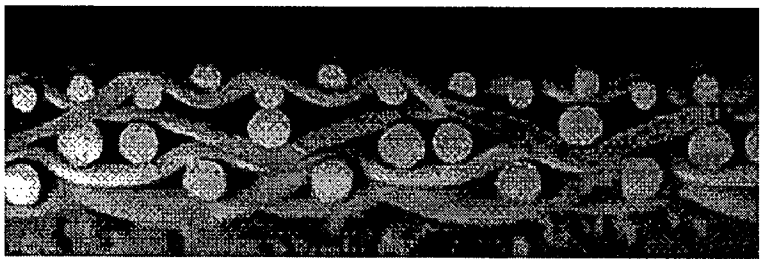
FIG. 5 shows: a) a CD cross-section picture along a binder yarn pair, b) a CD cross-section picture along the TSS structure, and c) a forming surface picture for the exemplary fabric shown in FIG. 3.
Figure 5:
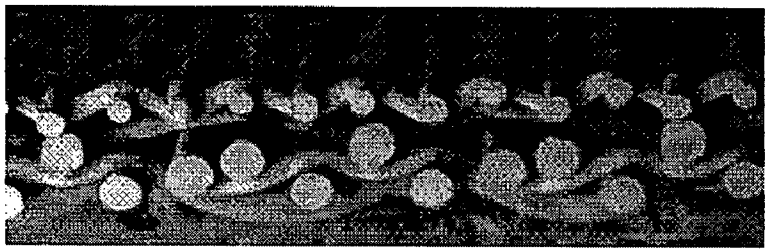
Figure 5:
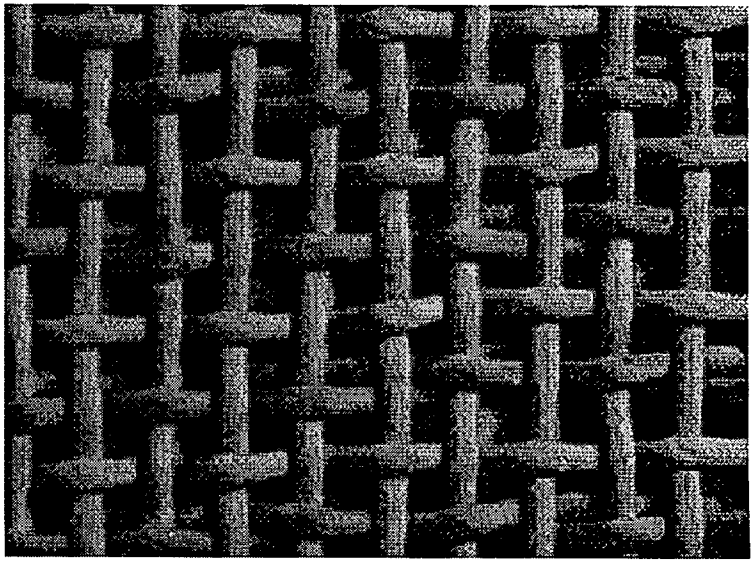

Sample fabrics according to the teachings of the present invention have been produced to determine their performance characteristics. FIG. 4 shows: a) a CD cross-section picture along a binder yarn pair, b) a CD cross-section picture along the TSS structure, and c) a forming surface picture for the exemplary fabric illustrated by FIGS. 1A, 1B, and 2. FIG. 5 shows: a) a CD cross-section picture along a binder yarn pair, b) a CD cross-section picture along the TSS structure, and c) a forming surface picture for the exemplary fabric illustrated by FIG. 3. The forming surface pictures in FIGS. 4 and 5 clearly show the plain weave surface pattern of the first layer. This plain weave pattern provides a surface uniformity normally lacking in TSS fabrics. Table 1 summarizes some of the sample fabric's characteristics in comparison to a reference triple-layer forming fabric having paired binder yarns. Notably, the sample fabric's lower contraction value indicates its construction provides improved stability. This improved stability should be expected given the present fabric's TSS structure.

TABLE 1

| Factor/Data | Sample fabric | Reference fabric |
|---|---|---|
| top shute diameter | 0.13 | 0.13 |
| binder pair diameter | 0.13 | 0.13 |

TABLE 1-continued

| Factor/Data | Sample fabric | Reference fabric |
|---|---|---|
| third CD yarn | 0.20 | N/A |
| bottom yarn diameter | 0.30 | 0.30 |
| picks/cm | 100 | 82 |
| weight (g/m$^2$) | 582 | 506 |
| knuckles/mm$^2$ | 1090 | 1133 |
| void volume | 0.55 | 0.47 |
| air permeability (m/s) | 1.28 | 1.41 |
| modulus (MN/m) | 1.49 | 1.39 |
| contraction (m/MN) | 0.078 | 0.266 |

The fabric according to the present invention preferably comprises only monofilament yarns. However, the third CD yarn may be a different material and/or a different diameter than some of the other CD yarns. Specifically, the CD yarns may be polyester monofilament and/or some may be polyester and polyamide yarns. The CD and MD yarns may have a circular cross-sectional shape with one or more different diameters. Further, in addition to a circular cross-sectional shape, one or more of the yarns may have other cross-sectional shapes such as a rectangular cross-sectional shape or a non-round cross-sectional shape.

Modifications to the above would be obvious to those of ordinary skill in the art, but would not bring the invention so modified beyond the scope of the present invention. The claims to follow should be construed to cover such situations.

What is claimed is:

1. A papermaker's fabric comprising:

a first layer and a second layer of machine direction (MD) yarns;

a first system of cross-machine-direction (CD) yarns comprising a first CD yarn and a second CD yarn; said first CD yarn and said second CD yarn forming a binding pair of yarns;

wherein said binding pair is interwoven with the first and second layers of MD yarns in such a manner that the first CD yarn and the second CD yarn combine to weave each MD yarn in the first layer and cross between the first layer and the second layer;

a second system of CD yarns comprising a third CD yarn, a fourth CD yarn, and a fifth CD yarn; said first system and said second system alternating in weaving with the MD yarns;

wherein said fourth CD yarn weaves each MD yarn in the first layer and said fifth CD yarn weaves with at least one MD yarn in the second layer;

wherein said third CD yarn is positioned between the fourth and fifth CD yarns; and wherein the third, fourth, and fifth CD yarns are vertically-stacked, perpendicular to the first and second layers.

2. The papermaker's fabric according to claim 1, wherein the fabric is a triple layer forming fabric.

3. The papermaker's fabric according to claim 1, wherein the first layer is a forming layer of the fabric and the second layer is a wear side layer of the fabric.

4. The papermaker's fabric according to claim 1, wherein the fabric has a 2:1 shute ratio.

5. The papermaker's fabric according to claim 1, wherein at least some of the MD yarns and CD yarns are monofilament yarns.

6. The papermaker's fabric according to claim 1, wherein the binding pair is woven in a reverse pick configuration.

7. The papermaker's fabric according to claim 1, wherein the binding pair is woven in a straight pick configuration.

8. The papermaker's fabric according to claim 1, wherein the binding pair is woven in a sheet support binder (SSB) sequence.

9. The papermaker's fabric according to claim 1, wherein the second system of CD yarns form a triple stacked shute (TSS) structure.

10. The papermaker's fabric according to claim 1, wherein at least some of the fifth CD yarns form long floats on the outer surface of the second layer.

11. The papermaker's fabric according to claim 1, wherein the third CD yarn is a different material than the fourth and fifth CD yarns.

12. The papermaker's fabric according to claim 1, wherein the third CD yarn is a different diameter than the fourth and fifth CD yarns.

13. The papermaker's fabric according to claim 1, wherein the third CD yarn is positioned between the first and second layers.

14. The papermaker's fabric according to claim 1, wherein the third CD yarn binds with at least one of the MD yarns in the second layer.

15. The papermaker's fabric according to claim 1, wherein the MD yarns and CD yarns have a circular cross-sectional shape, a rectangular cross-sectional shape or a non-round cross-sectional shape.

* * * * *